United States Patent [19]

Kakitani

[11] Patent Number: 4,942,429

[45] Date of Patent: Jul. 17, 1990

[54] IMAGE RECORDING APPARATUS WITH A REMOVABLE DEVELOPING UNIT

[75] Inventor: Yohtaro Kakitani, Yokosuka, Japan

[73] Assignee: Ricoh Company, Ltd., Tokyo, Japan

[21] Appl. No.: 276,549

[22] Filed: Nov. 28, 1988

[30] Foreign Application Priority Data

Nov. 30, 1987 [JP] Japan ..... 62-302493

[51] Int. Cl.[5] ..... G03G 15/00; G03G 15/01

[52] U.S. Cl. ..... 355/208; 355/246; 355/260

[58] Field of Search ..... 355/203-209, 355/245, 246, 326, 327, 260

[56] References Cited

FOREIGN PATENT DOCUMENTS 60-126667 7/1985 Japan .

61-282855 12/1986 Japan ..... 355/209

*Primary Examiner*—Joan H. Pendegrass

*Attorney, Agent, or Firm*—Oblon, Spivak, McClelland, Maier & Neustadt

[57] ABSTRACT

A developing unit or similar recording unit which is removably mounted on an image recording apparatus is provided with a constant voltage device or similar level adjusting means which has a particular characteristic matching with recording color of the recording unit. The level adjusting means changes the level of a power supply (e.g. voltage) fed from a body of the apparatus to a level particular to the recording unit, i.e., to the color of toner stored therein. Identifying such a particular level, the apparatus body automatically sets up process conditions which are optimum for the identified level. Hence, the level detected by the apparatus body changes depending upon the kind of a recording unit actually mounted on the apparatus body, whereby optimum process conditions are set up.

7 Claims, 3 Drawing Sheets

IMAGE RECORDING APPARATUS WITH A REMOVABLE DEVELOPING UNIT

BACKGROUND OF THE INVENTION

The present invention relates to an electrophotographic copier or similar image recording apparatus of the type having a developing unit which is replaceable with another for changing recording color.

In an electrophotographic copier, for example, an imagewise reflection from a document is focused onto a photoconductive element to form an electrostatic latent image thereon. The latent image is developed by a developing unit which stores a developer in the form of toner therein. More specifically, toner is deposited on the photoconductive element in association with the potential distribution of the latent image to produce a toner image. Recording color, therefore, can be changed by replacing the toner of particular color with toner of another color. A relatively inexpensive copier available today is operable with a plurality of developing units each storing toner of different color and being replaceable with each other to select desired recording color. A problem heretofore pointed out is that a change in the kind, particularly color, of toner to be used causes the individual recording characteristics to change with respect to various process factors, e.g. bias voltage for development, transfer current, amount of exposing light, and toner density. Since a desirable recording in unachievable unless optimum and accurately determined recording conditions are selected with respect to the above-mentioned process conditions, it is preferable that a change in color be accompanied by a change in process conditions.

For changing the recording conditions as stated above, it has been customary to install in each developing unit an exclusive mechanical part for the identification of toner color or to rely on operator's manipulations of a mode switch. A drawback with the extra mechanical part scheme is the complicated and expensive construction, and another drawback is that each developing unit storing toner of particular color should be provided with a different mechanical structure. On the other hand, the mode switch scheme is apt to invite erroneous manual operations which would render a recording incomplete and forces the operator to withstand troublesome operations for the confirmation of recording color.

SUMMARY OF THE INVENTION

It is therefore an object of the present invention to provide an image recording unit with a removable developing unit which makes it needless to change the conditions associated with individual process factors even when the recording color is changed.

It is another object of the present invention to provide an inexpensive image recording unit with a removable developing unit.

It is another object of the present invention to provide a generally improved image recording apparatus with a removable developing unit.

An image recording apparatus comprising recording means which includes at least a developing unit which is removably mounted on a body of the apparatus of the present invention comprises a power supply installed in the body of the apparatus for feeding power to the recording means, a level adjusting device installed in the recording means for producing a signal a level of which is changed on the basis of power which the power supply generates in association with characteristics particular to a developer stored in the developing unit, and a condition changing circuit for identifying the level of the signal outputted by the level adjusting device and, based on a result of identification, selectively changing at least one of a plurality of recording process factors.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
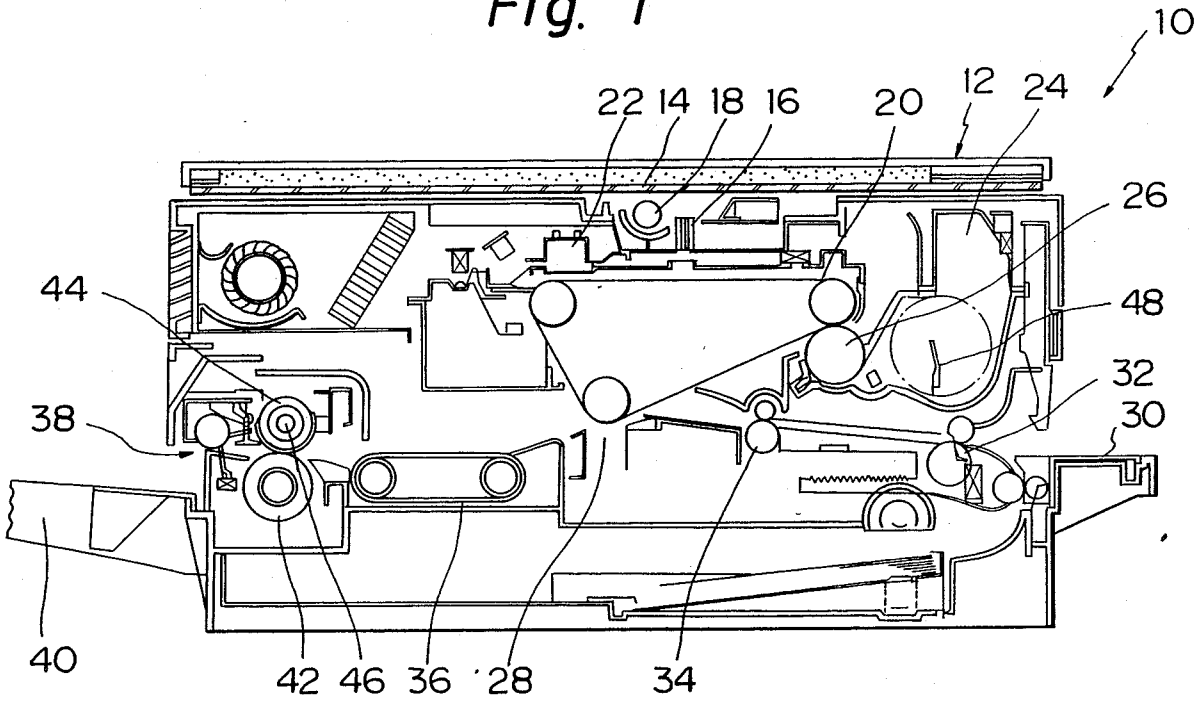
FIG. 1 is a schematic front view showing the general construction of a copier to which the present invention is applied.

Referring to FIG. 1 of the drawings, a copier representative of a family of image recording apparatuses to which the present invention is applicable is shown. The copier, generally 10, includes a document support 12 which is provided with a glass platen 14 for laying a document thereon. A light conducting device 16 is implemented by a fiber optic bundle and disposed below the glass platen 14. A lamp 18 is located below the glass platen 14 to illuminate the document. An imagewise reflection from the document is propagated through the light conducting device 16 to be focused onto a photoconductive element in the form of a belt 20. Extending linearly and perpendicularly to the sheet surface of FIG. 1, the light conducting device 16 conducts to the belt 20 one line of optical data which is associated with a particular portion of the document which the device 16 faces. In the illustrative embodiment, the support 12 is movable in a reciprocating motion in the left-and-right direction as viewed in FIG. 1, whereby the document is scanned in the subscanning direction.

A main charger 22 uniformly charges the surface of the belt 20 to a predetermined high potential. As the imagewise light from the document is incident to the belt 20, an electrostatic latent image in the form of a potential distribution is produced on the belt 20 in association with intensity distribution of the incident light. A developing unit 24 is provided for converting the latent image into a toner image. Specifically, toner stored in the developing unit 24 is deposited on the belt 20 based on the potential distribution as a part of the belt 20 where the latent image exists is brought to the vicinity of a developing roller 26, thereby converting the latent image into a toner image. When the toner image is caused to face a transfer charger 28 due to the movement of the belt 20, it is transferred to a paper sheet which is fed toward the surface of the belt 20 at a predetermined timing in synchronism with the movement of the belt 20. The paper sheet fed from either one of a manual insertion table 30 or a paper cassette is laid on the belt 20 by way of a feed roller 32 and a register roller 34. The paper sheet with the toner image is transported by a belt 36 to a fixing unit 38 for fixing the toner image and then driven out of the copier to a copy tray 40. The fixing unit 38 includes a pressing roller 42, a fixing roller 44, and a heater 46.

Figure 2A:
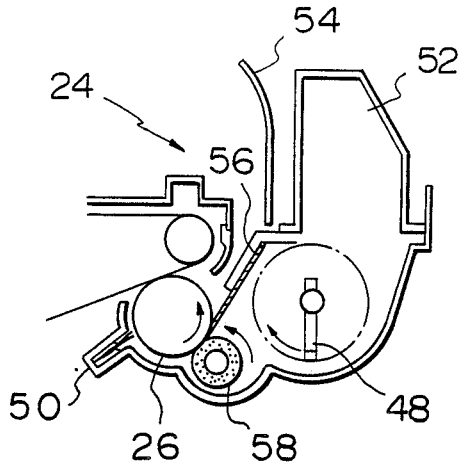
FIGS. 2A and 2B are respectively a fragmentary front view and a fragmentary perspective view each showing a developing unit of the copier shown in FIG. 1 in an enlarged scale.
Figure 2B:
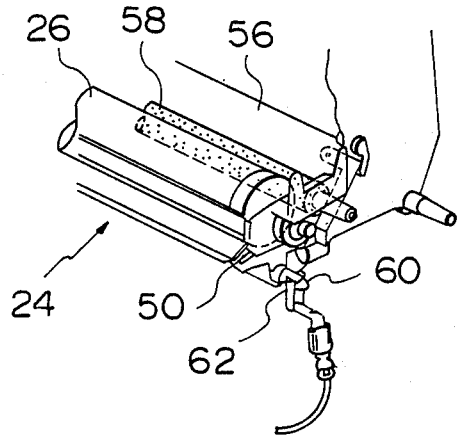

Referring to FIGS. 2A and 2B, a specific construction of the developing unit 24 is shown. As shown, the developing unit 24 includes an agitator 48, a discharging brush 50, a toner cartridge 52, a developing roller cover 54, a developing blade 56, a toner supply roller 58 and an electrode shaft 60 as well as the developing roller 26. The unit 24 is bodily removable from the body of the copier 10 and replaceable with ease. More specifically, the copier 10 is operable with a plurality of developing units each storing toner of particular color and being replaceable with each other for changing recording color. When the developing unit 24 is mounted in a predetermined position within the copier body, the electrode shaft 60 is held in contact with an electrode plate 62 to feed predetermined power to the unit 24. In this condition, each of the brush 50, roller 26 and blade 56 of the developing unit 24 is supplied with a particular bias voltage for development.

Figure 3:
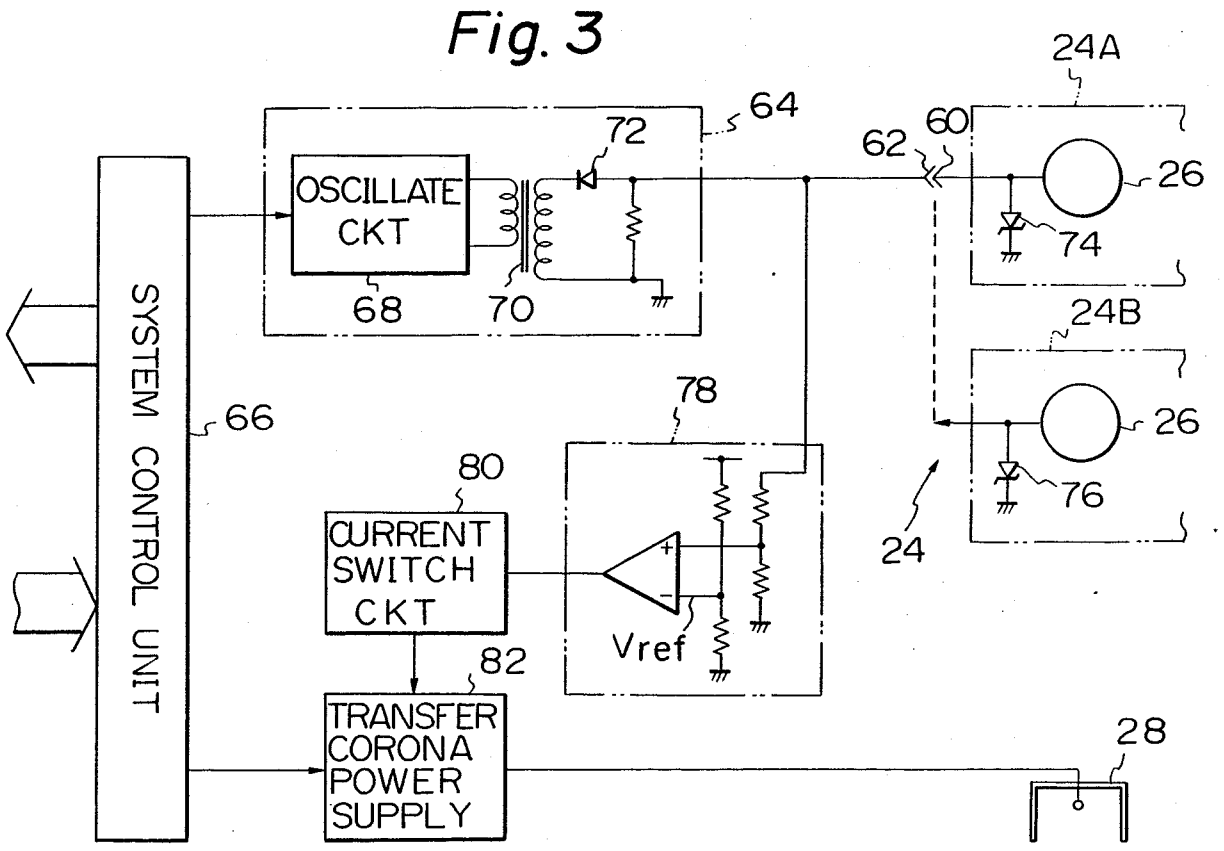
FIG. 3 is a schematic block diagram showing electrical circuitry installed in the copier of FIG. 1.

FIG. 3 shows a part of electrical circuitry installed in the copier 10. In the figure, a bias power supply 64 generates power to be supplied to the developing unit 24 (24A and 24B). As a system control unit 66 energizes an oscillation circuit 68, an AC signal appearing on the output of the oscillation circuit 68 is boosted by a boost transformer 70 and then rectified by a diode 72 to be fed to the electrode plate 62 as a DC voltage (e.g. −300 volts). A Zener diode or similar constant voltage device is built in the developing unit 24 for generating a bias voltage for development. In the illustrative embodiment, Zener diodes 74 and 76 are associated with the developing units 24A and 24B, respectively. Zener voltages of the Zener diodes 74 and 74 are assumed to be 250 volts and 150 volts, respectively. It follows that when the developing unit 24A is mounted on the copier body, the voltage appearing on the output terminal of the bias power supply 64 is changed to −250 volts and, when the developing unit 24B is mounted, it is changed to −150 volts. The roller 26 and others of the developing unit 24 are therefore supplied with a bias voltage for development which depends upon the characteristic of the Zener diode 74 or 76. For details of a constant voltage device used with a developing unit, a reference may be made to Japanese Laid-Open Patent Publication (Kokai) No. 60-126667 by way of example.

In the illustrative embodiment, each of the developing units 24A and 24B is provided with a Zener diode having a different characteristic which provides a bias voltage optimum for the kind, especially color, of toner stored in the unit. More specifically, every time the developing unit is replaced, an optimum bias voltage for development is automatically set up in matching relation to the kind of toner which is stored in an alternative developing unit.

A comparing circuit 78 is connected to the output terminal of the bias power supply 64. The comparing circuit 78 compares a reference voltage Vref and a voltage which is produced by dividing the output level of the bias power supply 64, delivering a binary signal representative of a result of comparison to a current switching circuit 80. More specifically, the output of the comparing circuit 78 is either a (logical) ONE or a (logical) ZERO depending upon the output level of the bias power supply 64 which is either −250 volts or −150 volts. In response to the binary signal from the comparing circuit 78, the current switching circuit 80 switches the value of current to be fed from a transfer corona power supply 82. While the transfer charger 28 is powered by the corona power supply 82 to cause corona discharge, the value of current which flows during the discharge is maintained constant by the transfer corona power supply 82. In this embodiment, two different current values are available and the current switching circuit 80 selects one of such two current values. The system control unit 66 on-off controls the transfer corona power supply 82 according to predetermined copy process timings.

In this embodiment, therefore, both of the bias voltage for development and the transfer current are automatically changed when a developing unit is replaced, in association with the kind of toner stored in the developing unit actually mounted. Since each toner of particular color has a different developing characteristic and a different transfer characteristic, changing the bias voltage and transfer current depending upon the kind of toner is successful in achieving optimum recording characteristics without fail, whatever the color of toner may be.

While each of the developing units 24A and 24B is provided with an exclusive Zener diode as shown and described, the output voltage of the bias power supply 64 under the unloaded condition may be selected to be −250 volts so as to omit the diode 74 which is associated with the developing unit 24A. In the illustrative embodiment, only black toner and color toner are identified in distinction from each other. Alternatively, the color toner may be further classified into red toner, blue toner, green toner and so on and the bias voltage and transfer current may be selected in association with each of such color toner. In such a case, each of the developing units should be provided with a constant voltage device having a different characteristic, the comparator 78 should be replaced with an analog-to-digital converter capable of identifying an input with respect to multiple levels, and the current switching circuit 80 should be designed to accommodate multiple levels. It is to be noted that the Zener diodes 74 and 76 may be replaced with varistors or similar bias voltage generating devices so long as they are capable of providing a constant voltage characteristic.

In the case that the bias voltage for development does not have to be changed unit by unit, the constant voltage devices which serve as level changing means may be replaced with a resistance type potential divider, for example, and the output thereof may be coupled to the comparing circuit 78. In such an alternative arrangement, it will be necessary to install an extra signal line for the connection of the copier body and the developing unit.

If desired, the amount of light issuing from the lamp 18, potential deposited on the belt 20, toner density and other similar process factors may be changed in place of the bias voltage for development and transfer current to which the illustrative embodiment pertains.

In summary, in accordance with the present invention, a developing unit or similar recording unit which is removably mounted on an image recording apparatus is provided with a constant voltage device or similar level adjusting means which has a particular characteristic matching with the recording color of the recording unit. The level adjusting means changes the level of a power supply (e.g. voltage) fed from a body of the apparatus to a level particular to the recording unit, i.e., to the color of toner stored therein. Identifying such a particular level, the apparatus body automatically sets up process conditions which are optimum for the identified level. Hence, the level detected by the apparatus body changes depending upon the kind of a recording unit actually mounted on the apparatus body, whereby optimum process conditions are set up. This allows the kind of a recording unit to be determined without resorting to extra mechanical parts or electrical parts such as sensors and, therefore, allows all the replaceable recording units each being assigned to a particular color to have an identical structure while eliminating the need for positional adjustments.

Further, in accordance with the present invention, the level adjusting means is implemented by a Zener diode or similar semiconductor constant voltage device and lowers a voltage appearing on the output of a power supply of the apparatus body to a bias voltage for development particular to a recording unit, the resulting voltage being applied to a bias electrode. Since the voltage appearing on the output terminal of the power supply changes depending upon the kind of a recording unit, the recording color is identified by monitoring that voltage and, based on the result of identification, the other process conditions (e.g. transfer current) are also changed automatically. Therefore, a power supply line for feeding bias power for development bifunctions as a signal line for identifying the recording color, whereby the need for an extra wiring is eliminated to simplify the connection of the apparatus body and the recording unit.

Various modifications will become possible for those skilled in the art after receiving the teachings of the present disclosure without departing from the scope thereof.

What is claimed is:

1. An image recording apparatus comprising recording means which includes at least a developing unit which is removably mounted on a body of said apparatus, said apparatus comprising:

power supply means installed in said body of said apparatus for feeding power to said recording means;

level adjusting means installed in said developing unit for producing a signal a level of which is changed on the basis of power which is generated by said power supply means in association with characteristics particular to a developer stored in said developing unit and is applied to said developing unit as a developing bias voltage; and condition changing means for identifying the level of the signal outputted by said level adjusting means and, based on a result of identification, selectively changing at least one of a plurality of recording process factors.

2. An image recording apparatus comprising recording means which includes at least a developing unit which is removably mounted on a body of said apparatus, said apparatus comprising:

power supply means installed in said body of said apparatus for feeding power to said recording means;

level adjusting means installed in said recording means for producing a signal a level of which is changed on the basis of power which said power supply means generates in association with characteristics particular to a developer stored in said developing unit including a semiconductor constant voltage device for maintaining a potential difference between opposite terminals of said level adjusting means substantially constant, said constant voltage device changing the level appearing on an output terminal of said power supply means to a lower level than a level which holds when said constant voltage device is not connected; and condition changing means for identifying the level of the signal outputted by said level adjusting means and, based on a result of identification, selectively changing at least one of a plurality of recording process factors.

3. An apparatus as claimed in claim 1, wherein said semiconductor constant voltage device comprises a Zener diode.

4. An apparatus as claimed in claim 1, wherein said condition changing means identifies the level appearing on said output terminal of said power supply means and, based on a result of identification, selectively changes the recording process factor.

5. An apparatus as claimed in claim 1, wherein said constant voltage device is connected at one end to a developing bias electrode which is provided in said developing unit.

6. An image recording apparatus comprising recording means which includes at least a developing unit which is removably mounted on a body of said apparatus, said apparatus comprising:

power supply means installed in said body of said apparatus for feeding power to said recording means;

level adjusting means installed in said recording means for producing a signal a level of which is changed on the basis of power which said power supply means generates in association with characteristics particular to a developer stored in said developing unit; and condition changing means for identifying the level of the signal outputted by said level adjusting means and, based on a result of identification, selectively changing a set current of a corona discharging unit which joins in the transfer of a developed image to a paper sheet depending upon the result of identification.

7. An apparatus as claimed in claim 1, wherein said recording process factor comprises at least one of a bias voltage for development, a transfer current, an amount of light for exposure, and a toner density.

* * * * *